United States Patent [19]

Boucherie

[11] Patent Number: 4,527,838

[45] Date of Patent: Jul. 9, 1985

[54] ARRANGEMENT FOR FILLING CASSETTES WITH FIBRES

[75] Inventor: Leonel P. Boucherie, Roeselare-Rumbeke, Belgium

[73] Assignee: Firma G. B. Boucherie, Belgium

[21] Appl. No.: 470,952

[22] Filed: Mar. 1, 1983

[30] Foreign Application Priority Data

Mar. 4, 1982 [BE] Belgium ..... 59615

[51] Int. Cl.[3] ..... A46D 1/04

[52] U.S. Cl. ..... 300/7; 221/251; 300/12

[58] Field of Search ..... 300/1–19; 221/225, 227, 232, 238, 239, 251, 254; 222/366, 361

[56] References Cited

U.S. PATENT DOCUMENTS 3,450,312 6/1969 Boucherie ..... 221/251

4,111,491 9/1978 Steinebrunner et al. ..... 300/7 X

*Primary Examiner*—Mark Rosenbaum

*Attorney, Agent, or Firm*—Bacon & Thomas

[57] ABSTRACT

Arrangement for filling cassettes with fibres, characterized thereby that it consists of the combination of a supply magazine, in this supply magazine a displaceable pressing member on the one hand and second pressing members on the other hand, means that can command the pressing member or the second pressing means, separating means that can separate a well-determined amount of fibres, second separating means able to further free the fibres from each other, means able to remove the separated fibres from the supply magazine and a cassette that can receive this small amount of fibres.

13 Claims, 15 Drawing Figures

Fig. 8
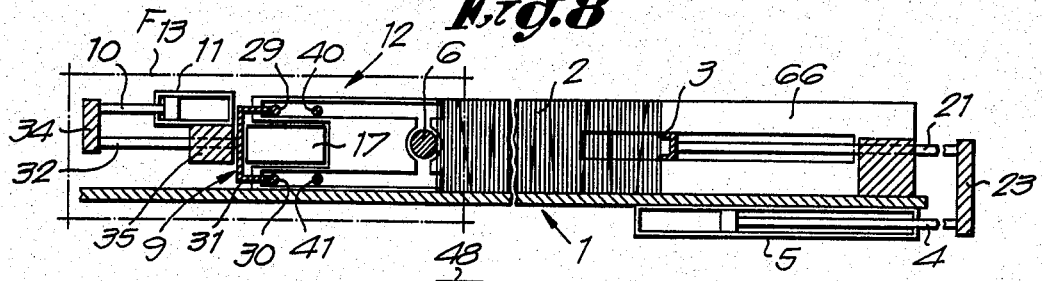
Fig. 9
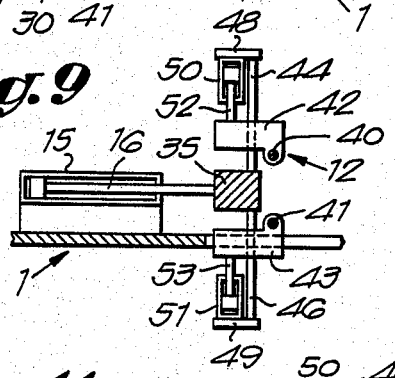
Fig. 10
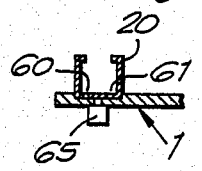
Fig. 11
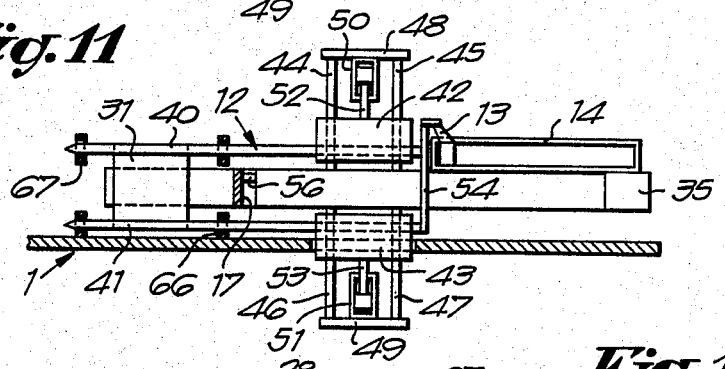
Fig. 12
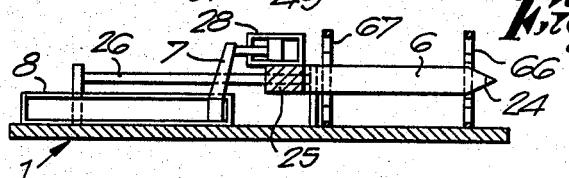
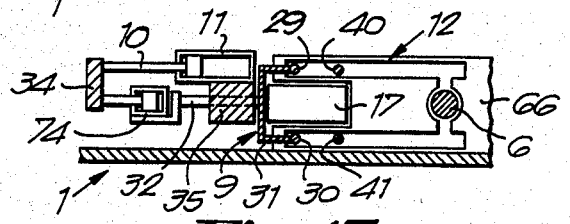
Fig. 13

ARRANGEMENT FOR FILLING CASSETTES WITH FIBRES

BACKGROUND OF THE INVENTION

This invention relates to an arrangement for filling cassettes whose main purpose is to see that from a larger amount of fibres suitable smaller portions be taken which are brought into a cassette and wherein the thus filled cassettes are to be used for being placed efficiently and rationally into the fibre magazine of a brush-making machine and after removal of the cassettes to transfer the fibres placed herein into said fibre magazine, whereupon these cassettes can be used again for bringing a next charge of fibres into the brush-making machine.

Although such cassette-loading arrangement or cassette can be applied to any kind of fibres, a very specific application is to be found in working up vegetable natural fibres, e.g. for making brooms, wherein, as is known, one starts from heavy and practically round bundles of fibres with a diameter of about 45 cm, which at half their height are held together by means of a rope or the like and from which it is known that the fibres are tough, strongly entangled and contain much dust and waste.

It is also known that up to now the operator of such brush-making machine has to open said bundles by hand, manually separate small parts of it and bring the latter into the fibre magazines.

As these fibre magazines are rather narrow and in the modern, high-speed brush-making machines two brooms are produced simultaneously, one single machine operator cannot follow the filling step of said magazines.

Further, it is known that manually separating small parts of fibres from the said commercially available bundles is attended by much waste, which is mainly due to the fact that the strongly entangled fibres have to be disentangled energetically, whereby a major procentual part of the fibres falls as waste to the ground or is mixed up in such a way that these entangled fibres are simply removed because otherwise too much time would be lost.

SUMMARY OF THE INVENTION

So, it is the object of this invention to reduce the task of the operator of the brush-making machine, especially with respect to filling the fibre magazines, to an absolute minimum;

- to completely eliminate the manual working up of the fibres;
- to achieve a considerable saving of fibres, in other words to avoid fibre loss as much as possible;
- allowing the operator of one machine to handle several machines simultaneously;
- allowing the brush-making machine to run at higher speed;
- and as a result of the above advantages to obtain a machine with high efficiency together with lower wages whereby the cost-price of the finished product is favourably influenced, whereby the arrangement can be set up in direct co-operation with a brush-making machine as well as independently; in the latter case cassettes can suitably be filled with fibres and optionally can be carried away automatically to brush-making machines.

For this purpose the arrangement of the present invention showing the aforesaid and still other advantages mainly consists of the combination of a storage magazine for fibres, one pressing element movable in this storage magazine and acting on one side of the bundle of fibres; in this storage magazine second pressing means acting on the second end of said bundle of fibres; means that can command said pressing element or the aforesaid second pressing means in order to displace the fibre bundle; separating means that are able to separate a determined amount of fibres from said fibre bundle; second separating means that can co-operate with said separating element in order to further free from each other or to disentangle the entangled fibres of the separated fibre part and the part of fibres in the proper fibre storage magazine; means that can remove the separated amount of fibres from the storage magazine and a cassette that can receive this small amount of fibres.

BRIEF DESCRIPTION OF THE DRAWINGS

In order to better show the main characteristics of the arrangement according to the present invention, a preferred embodiment is described below without limiting the scope of the invention with reference to the accompanying drawings wherein:

FIGS. 8, 9, 10, 11 and 12 are cross-sections according to lines VIII—VIII, IX—IX, X—X, XI—XI and XII—XII respectively in FIG. 7;

FIG. 13 represents a variant of the part indicated in FIG. 8 by F13;

Figure 1:
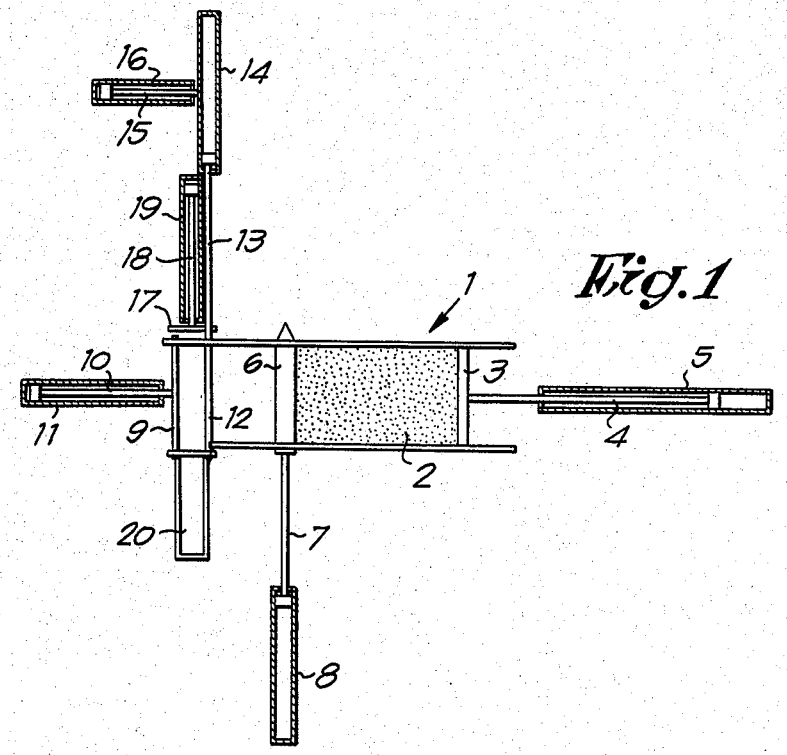
FIGS. 1 to 6 schematically represent the most elementary form of the arrangement of the present invention in different positions.
Figure 2:
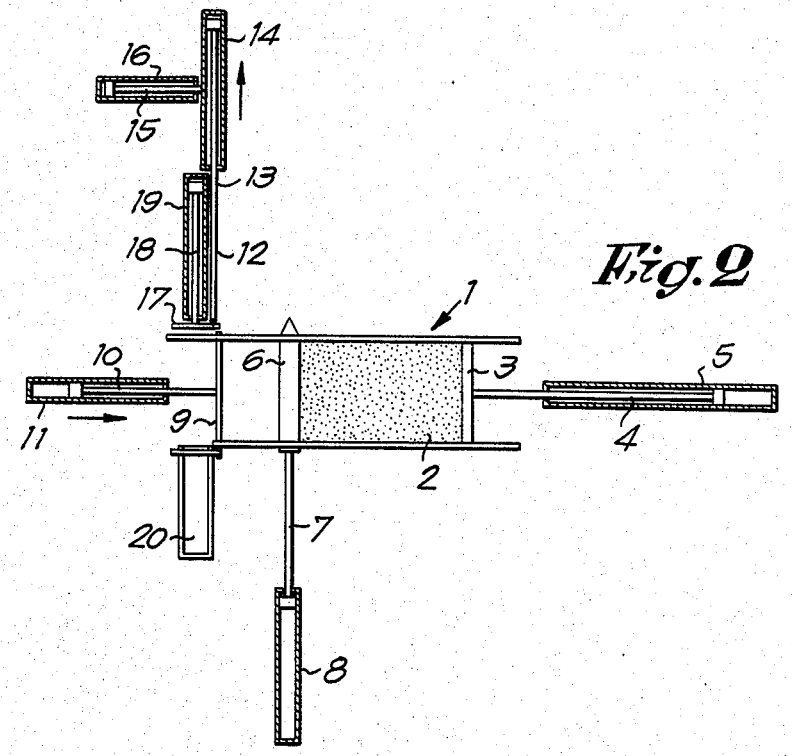

The arrangement according to the invention which is represented in the FIGS. 1 to 6 schematically and in its simplest form mainly consists of a storage magazine 1 for fibres 2; a first pressing element 3 fixed to the free end of the piston rod 4 of a pressure cylinder 5; a first separating element 6 fixed to the free end of the piston rod 7 of a pressing cylinder 8; a second pressing means 9 fixed to the free end of piston rod 10 of a pressing cylinder 11; a second separating means 12 fixed to the free end of the piston rod 13 of a pressing cylinder 14, which in its turn is fixed to the free end of piston rod 15 of a pressing cylinder 16, pushing elements 17 fixed to the free end of a piston rod 18 of a pressing cylinder 19 and a cassette 20 able to receive fibres 2.

In FIG. 1 is represented the situation wherein the fibre magazine 1 is filled with a determined amount of fibres 2, which under the influence of the pressing element 3 are pushed against the separating element 6 which is mounted straight across the filling magazine 1.

In a next phase of the working of the arrangement according to the invention (see FIG. 2) the separating elements 12 are moved back, whereas both pressing means 9 are moved forward till above the separating means 6, whereas by properly influencing the pressing cylinder 16 the separating means 12 are displaced to a vertical plane passing through the separating means 6 (see FIG. 3), whereafter the separating means 6 are removed from the supply magazine and at the same time the pressing means 9 and 3 are moved in the same sense over a well-determined distance.

Figure 6:
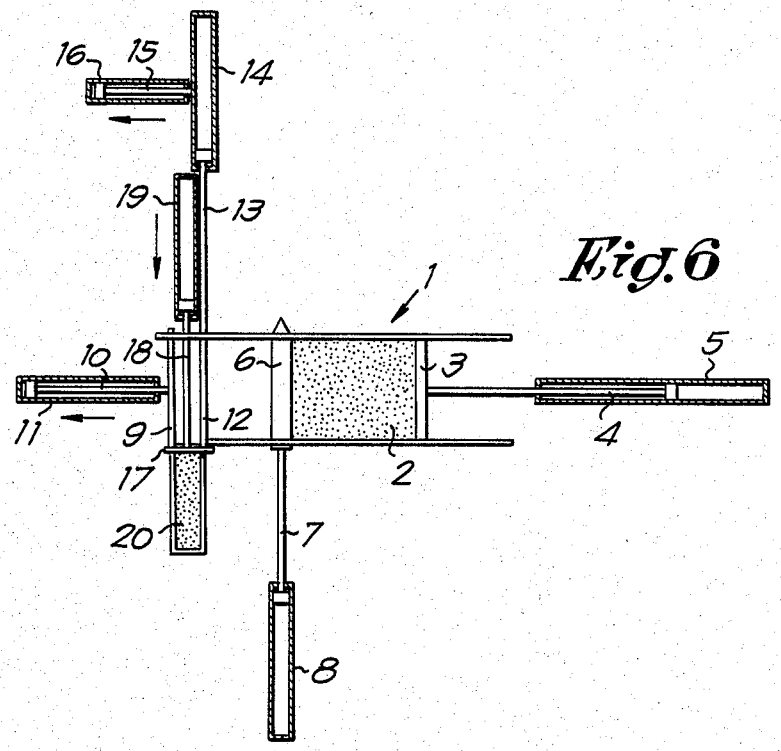

Then on the one hand the separating means 6 and thereafter the separating means 12 will be brought into the supply magazine 1 (see FIG. 5) in order, on the one hand, by means of the separating means 6, to separate a well-determined amount of fibres in the supply magazine 1 and then, by means of the separating means 12 to hold this amount of fibres at a well-determined distance from the pressing means 9, and thereafter by a simultaneous displacement over one same distance of the piston rods 10 and 15, to obtain that the separate amount of fibres 2 be placed in front of cassette 20 so that the arrangement is in the position of FIG. 1 with the difference that there are fibres between the parts 9 and 12, whereafter finally cylinder 19 is acted upon in order to bring the fibres into cassette 20 by means of the pushing elements 17 (see FIG. 6).

It suffices at this moment to properly fit this cassette 20 into the fibre magazine of a brush-making machine in order to transfer the fibres from this cassette into the fibre magazine.

In the FIGS. 7 to 12, an arrangement according to the present invention is represented in more detail, which arrangement starts from the same parts 1 to 20 as described above.

In this case the pressing piece 3 is made in a U-shape and is fixed to guiding rods 21 and 22 which are jointed to each other by a bridge 23 to which the said piston rod 4 is fixed (see FIG. 8).

The separating means 6 is formed by a cylindrical mandrel made of any material, e.g. plastic, which preferably is provided with a point 24 of hardened steel or the like, said mandrel being fixed to a slide 25 which is movable over guides 26 and 27 and said mandrel 6 being fixed to the element 7 acting as a piston rod by means of a pressing cylinder 28 (see FIG. 12).

In this case the pressing means 9 are formed by two rods 29 and 30, placed above each other and fixed to a U-shaped connecting member 31 which is fixed to rods 32–33 that are jointed to each other by a bridge 34 fixed to the piston rod 10 of the pressing cylinder 11.

The said rods 32 and 33 are freely slidable in a slide or carriage 35 which is fixed to rods 36–37 that can slide in the guides 38 and 39 fixed to the machine frame.

The separating means 12 in that case are formed by two rods 40–41, which are provided with a pointed end and each are slidably mounted in a slide 42–43 that can be shifted over guiding rods 44–45 and 46–47 (see FIG. 11), the latter at their free end being connected in pairs by a bridge 48–49 to which a pressing cylinder 50–51 is fixed whose piston rods 52 and 53 are jointed to the aforesaid slides 42 and 43.

The back ends of the rods 40 and 41 in this case are mounted, e.g. in a driving piece 54, e.g. in a common slot of this piece 54 in order to allow the relative motion of the rods 40 and 41 with respect to each other, this piece 54 being fixed to the piston rod 13 of the cylinder 14.

The attachment of the free ends of the rods 40 and 41 to the piece 54 can be made in any way.

The guiding rods 44 to 47 as well as cylinder 14 are attached to the aforesaid carriage 35 as is also the case with a pressing cylinder 19 whose free end of the piston rod 18 is fixed to the pushing member 17 by means of a connecting member 55 and a rod 56.

The arrangement according to the invention as described on the basis of FIGS. 7 to 12 is further completed by a pressing member 57 which is rotatably mounted to a spindle 58 and at the other side of this spindle is provided with a counterweight 59; positioning pins 60 and 61 are provided for meshing with holes 62 and 63 in the bottom 64 of the cassette 20; a switch 65 is provided that can be actuated by the cassette 20; in the side-walls 66 and 67 of the supply magazine 1 suitable slots (not shown) are provided forming guidance for the movements of rods 40–41; an access door 68 is provided in wall 67; and through this access door are provided blocks 69 and 70 at either side of the filling magazine, said blocks having holes that can mesh with a rod 73 through holes in the walls 67–66 and the holes of the pressing member 3.

Obviously, the working of the arrangement according to FIGS. 7 to 13 is identical with that described in the FIGS. 1 to 6 with the significant difference being that in this case, the rods 40–41 are drilled at a short distance above or below mandrel 6 in the fibre material 2 whereafter, in order to disentangle the fibres, these rods 40 and 41 can be removed from each other upwards or downwards, and that means are provided in the form of a rod 73 and holes 71–72 in blocks 69–70 which allow to retain the fibres 2 in the supply magazine when the pressing member 3 is moved back for placing a new bundle of fibres into the magazine 1 via the door 68.

In this embodiment too, the machine can only be started by placing a cassette 20 at the filling place whereby the switch 65 is pressed automatically and the correct positioning of this cassette is achieved by meshing the pins 60–61 with the holes 62–63.

Finally it should be noted that, if the penetration of the mandrel 6 into the fibres 2 would require too large a force, this penetration can be obtained optionally by intermittently moving the mandrel forward, which is obtained by the pressing cylinder 28.

Figure 3:
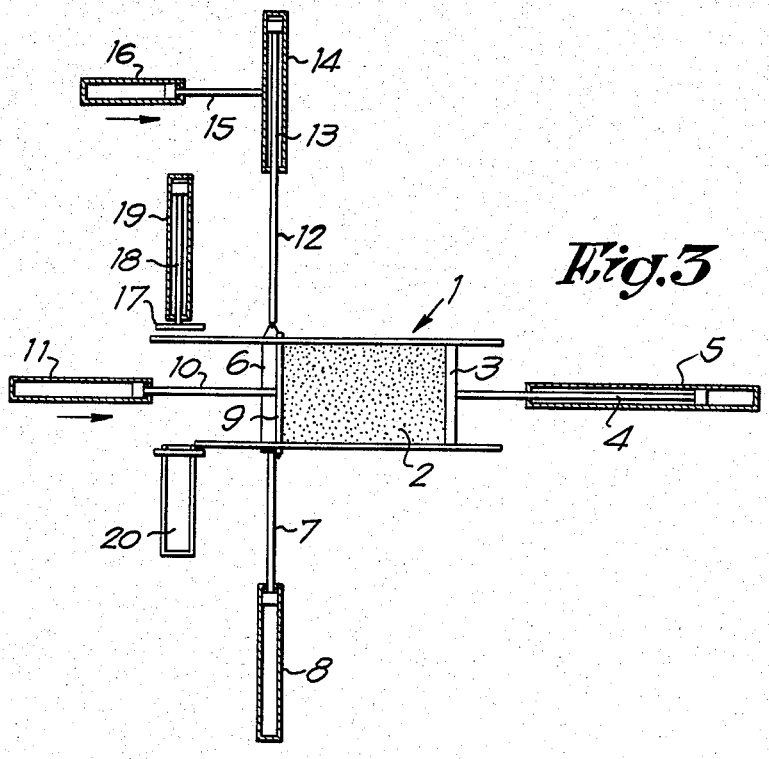
Figure 4:
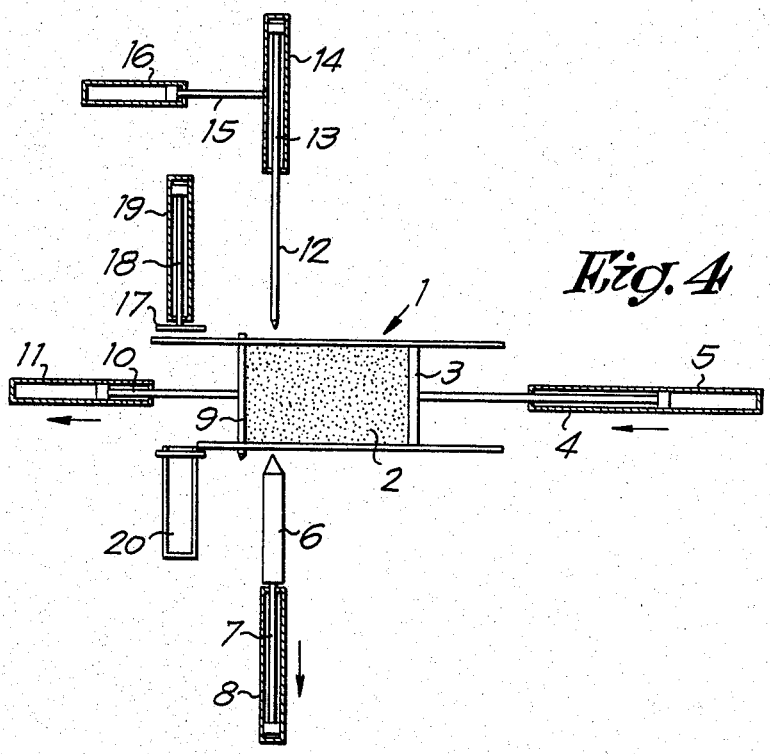
Figure 5:
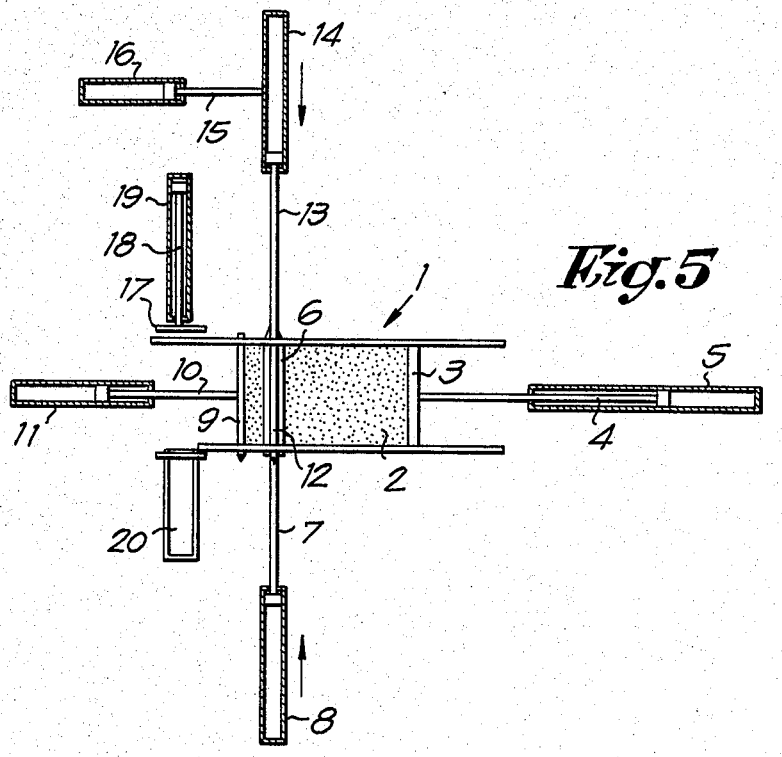

Further it is shown in FIG. 3 that depending on the nature of the fibres to be worked up, it may be advantageous to combine cylinder 11 with a second cylinder 74, which allows that, after the rods 40 and 41 have placed themselves above and below mandrel 6, enters the cylinder 74, whereby the rods 29 and 30 move themselves a little back with respect to the mandrel 6 which results therein that the amount of fibres 2 separated by mandrel 6 extends, in other words is no longer subjected to compression, so that the spindles 40 and 41 upon moving away from each other will be able to move with less friction, i.e. more easily, and thus will more readily loosen the entangled fibre ends.

Figures 7, 14, 15:
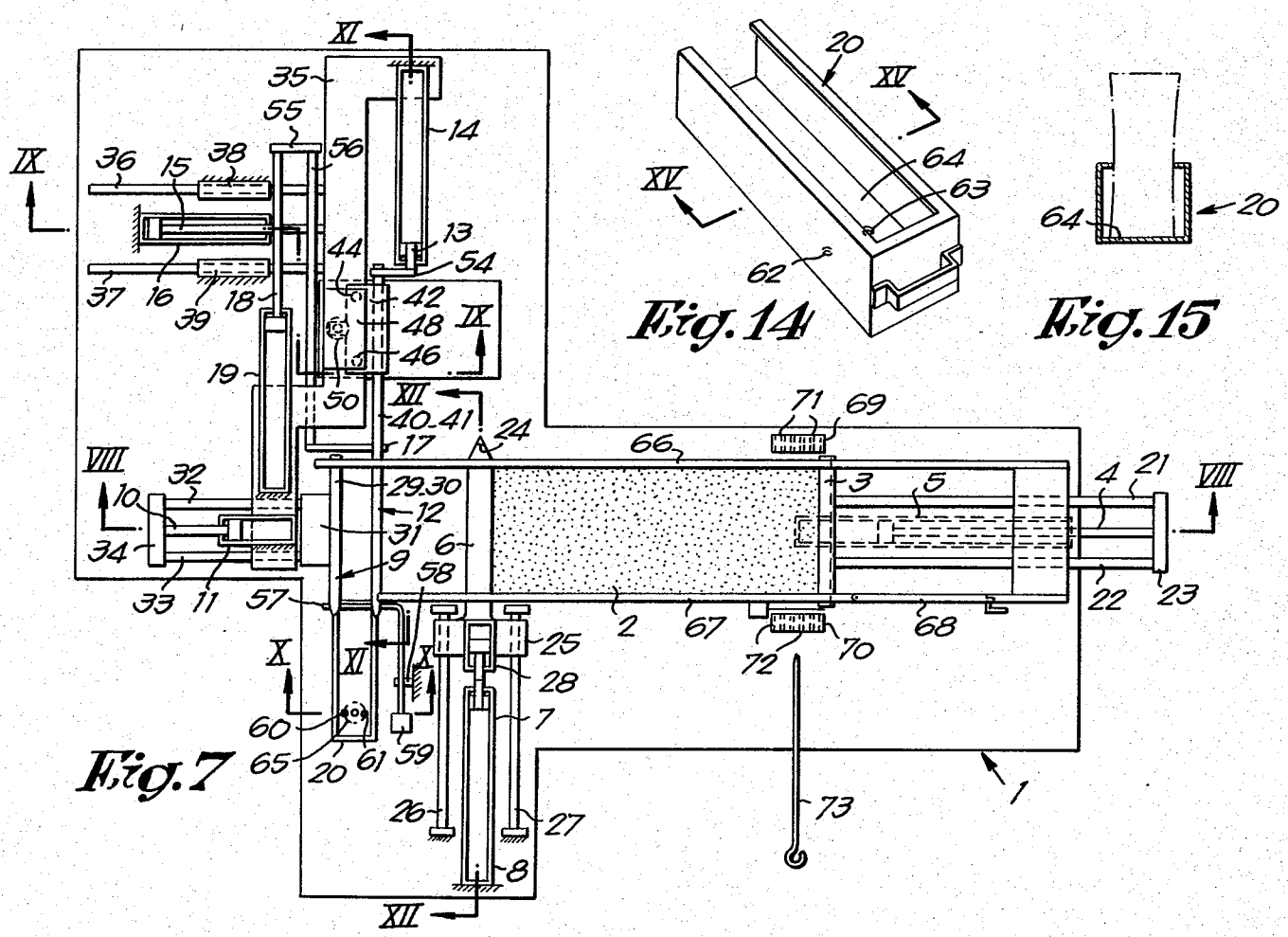
FIG. 7 is a view equal to that of FIG. 1, but for a more elaborated embodiment.
FIG. 14 is a perspective view of a cassette used in the arrangement according to the invention.
FIG. 15 represents a cross-section according to line XV—XV in FIG. 14.

When use is made of the combination according to FIG. 13, after the cylinder 16 has been actuated, in other words after the carriage 35 with the rods 40–41 in FIG. 7 have been moved to left, again leaving cylinder 74 whereby the small separated amount of fibres 2 is again compressed to a width somewhat smaller than the free opening (see FIG. 15) of the cassette so that an easy insertion of the fibres into the cassette is possible.

Evidently, the present invention is by no means limited to the embodiments described as an example and represented in the accompanying drawings, but such an arrangement can be realized in any shape and dimensions without departing from the scope of the invention.

What I claim is:

1. An apparatus for filling individual cassettes with predetermined amounts of fiber bundles of large diameter comprising:

(a) a magazine for containing a supply of fibers;

(b) a first pressing means slidable within the magazine for pressing the supply of fibers from a first side thereof;

(c) a second pressing means slidable within the magazine for pressing the supply of fibers from a second side thereof, with the first and second sides being opposed to each other;

(d) means for independently or jointly actuating the first and second pressing means;

(e) a first separating means for separating a predetermined amount of fibers from the supply of fibers;

(f) a second separating means for freeing the separated fibers;

(g) the second pressing means and the second separating means being mutually displaceable to secure and move the separated fibers to the open front portion of a cassette; and (h) means for disposing the separated fibers into the cassette.

2. The apparatus of claim 1 wherein the means for independently or jointly actuating the first and second pressing means includes a first piston rod and cylinder assembly operatively connected to the first pressing means and a second piston rod and cylinder assembly operatively connected to the second pressing means.

3. The apparatus of claim 1 wherein the first separating means includes an elongate mandrel and a piston rod and cylinder assembly for moving the mandrel into and out of the supply magazine.

4. The apparatus of claim 3 further including a second cylinder operatively connected to the piston rod and cylinder assembly for displacing the mandrel intermittently through the supply of fibers.

5. The apparatus of claim 3 wherein the second separating means includes a first piston rod and cylinder assembly for moving the second separating means into and out of the supply of fibers, and a second piston rod and cylinder assembly for displacing both the first piston rod and cylinder assembly and the second separating means.

6. The apparatus of claim 5 wherein the second separating means includes at least one separating rod, with the longitudinal axes of the separating rod and the mandrel being disposed in parallel, wherein displacement of both the first piston rod and cylinder assembly and the second separating means occurs in a direction perpendicular to the longitudinal axis of the separating rod.

7. The apparatus of claim 5 wherein the second separating means includes two separating rods disposed one above the other, a slide, and the rods being slidably engaged within the slide for movement towards and away from each other within a vertical plane.

8. The apparatus of claim 7 wherein the slide includes guide means and a common support having facing sides, wherein the guide means are mounted in line at the facing sides of the common support for permitting displacement of the rods within a horizontal plane.

9. The apparatus of claim 8 wherein the rods are axially displaceable.

10. The apparatus of claim 1 wherein the means for disposing the separated fibers within the cassette includes a pushing member and a piston rod and cylinder assembly for moving the pushing member between the second pressing means and the second separating means.

11. The apparatus of claim 1 wherein the magazine is defined by two parallel walls, guide grooves disposed in the walls for guiding the second separating means, and the first and second pressing means being positioned within planes disposed perpendicular to the parallel walls.

12. The apparatus of claim 11 further including an access door in one o the parallel walls.

13. The apparatus of claim 12 further including means for retaining the fibers during filling of the magazine.

* * * * *